US005804911A

United States Patent [19]

Van Gennip et al.

[11] Patent Number: 5,804,911

[45] Date of Patent: Sep. 8, 1998

[54] ELECTRODELESS LOW-PRESSURE DISCHARGE LAMP

[75] Inventors: Nicasius G. T. Van Gennip; Petrus J. M. Fransen, both of Eindhoven, Netherlands; Winand H. A. M. Friederichs, Bath, N.Y.; Petrus H. Antonis, Eindhoven, Netherlands

[73] Assignee: U.S. Philips Corporation, New York, N.Y.

[21] Appl. No.: 834,427

[22] Filed: Apr. 16, 1997

[30] Foreign Application Priority Data

Apr. 19, 1996 [EP] European Pat. Off. ..... 96201062

[51] Int. Cl.[6] ..... H01J 1/50

[52] U.S. Cl. ..... 313/318.01; 313/318.1; 313/35; 313/161; 313/46; 315/248

[58] Field of Search ..... 313/318.01, 318.1, 313/35, 161, 46, 318.09; 315/248, 344

[56] References Cited

U.S. PATENT DOCUMENTS 3,356,984 12/1967 Thorington et al. .
5,211,472 5/1993 Friederichs et al. .
5,258,683 11/1993 Eggink et al. .
5,381,070 1/1995 Tuttle et al. ..... 313/318.01
5,382,869 1/1995 Williamson et al. ..... 313/318.01
5,521,460 5/1996 Zhu ..... 313/318.09
5,621,266 4/1997 Popov et al. ..... 313/46

FOREIGN PATENT DOCUMENTS

2421328A1 10/1979 France .

*Primary Examiner*—Ashok Patel
*Attorney, Agent, or Firm*—F. Brice Faller

[57] ABSTRACT

An electrodeless low-pressure discharge lamp according to the invention is provided with a lamp vessel which is closed in a gastight manner and which has an ionizable filling. The lamp vessel has an end portion with a cavity in which an electric coil is accommodated. The cavity further contains a heat conductor which extends to outside the cavity and has a flange there with an axis, a circumference, a surface which faces away from the lamp vessel and a surface which faces the lamp vessel. A mounting member is connected to the lamp vessel and fastened against the flange. The mounting member is provided with at least one hook which points radially inwards and which cooperates with a recess in the surface of the flange which faces away from the lamp vessel. The recess issues into an axial groove at the circumference of the flange extending into the surface facing the lamp vessel. This construction renders possible a quick assembly of the mounting member with the flange.

9 Claims, 6 Drawing Sheets

ELECTRODELESS LOW-PRESSURE DISCHARGE LAMP

BACKGROUND OF THE INVENTION

The invention relates to an electrodeless low-pressure discharge lamp provided with a lamp vessel which has an ionizable filling, which is closed in a gastight manner, which has an end portion with a cavity in which an electric coil is accommodated, and in which in addition a heat conductor is accommodated which extends to outside the cavity and has a flange there with an axis, a circumference, a surface facing away from the lamp vessel and a surface facing the lamp vessel, a mounting member which is fastened to the flange being connected to the lamp vessel.

Such a lamp is known from U.S. Pat. No. 5,258,683 (PHN 13.574). The coil generates a high-frequency magnetic field for maintaining an electric discharge in the discharge vessel. The mounting member in the known lamp is fastened to the flange by means of screws. The mounting member has for this purpose chambers which are accessible from the outside and into which nuts have been inserted. The screws, which are countersunk with their heads into the surface of the flange which faces away from the lamp vessel, are turned into the nuts, thus keeping the flange clamped tightly against the mounting member. Assembling together of the mounting member and the flange is comparatively time-consuming, which is a disadvantage in particular for large scale manufacture.

SUMMARY OF THE INVENTION

It is an object of the invention to provide a lamp of the kind described in the opening paragraph which has a construction which renders possible a quicker joining together of the mounting member and the flange.

According to the invention, the lamp of the kind described in the opening paragraph is for this purpose characterized in that the mounting member is provided with at least one hook which points radially inwards and which cooperates with a recess in the surface of the flange which faces away from the lamp vessel, which recess issues into an axial groove at the circumference of the flange which extends up to the surface which faces the lamp vessel.

The mounting member can be easily assembled together with the flange in the lamp according to the invention. To achieve this, the mounting member is placed on the flange such that the hook of the mounting member slides through the axial groove, after which the mounting member is rotated relative to the flange such that the hook comes to rest in the recess of the flange. Although a single hook already achieves a coupling between the flange and the mounting member, it is favorable when the mounting member has a plurality of such hooks, for example three, each of them cooperating with a recess of the flange.

In an attractive embodiment, the mounting member is made of an elastic material, and the flange has a threshold between the recess and the axial groove, the threshold of the flange and the hook of the mounting member having mutually self-locating shapes in a direction away from the axial groove to the recess, while the threshold blocks the hook in an opposed direction. The hook can be rotated into the recess without obstruction during fastening of the mounting member on the flange. Uncoupling is prevented thereafter. If there are more recesses, a threshold is preferably present between each recess and its corresponding axial groove.

In a favorable embodiment, the end portion of the lamp vessel is fastened to a collar which has at least one projection pointing inwards, and the mounting member has an axial zone with a recess and with a raised step tangentially bounding said recess at an outer surface, the projection of the collar resting in the recess of the axial zone, while the raised step of the mounting member and the projection of the collar have mutually self-locating shapes in at least one tangential direction. This embodiment renders it possible to remove the lamp vessel with the collar fastened thereto and to replace it with another one, for example if the former lamp vessel was damaged or if a lamp vessel which emits light with a different color temperature is desired. For this purpose, the collar is rotated relative to the mounting member until the projection rests on the raised step next to the recess. The degree of resistance experienced by the user during this may be determined by those skilled in the art beforehand through the choice of the mutually matching shapes of the projection and the collar and of the raised step next to the recess. The collar may have, for example, a single projection which grips into a recess and thus keeps the collar coupled to the mounting member. Preferably, the collar has besides the at least one projection one or more further projections which each cooperate with a raised step in the axial zone of the mounting member, which projections, for example three in number, are distributed over the circumference of the collar.

Preferably, the recess in the axial zone of the mounting member is bounded by a tangential ridge at a side facing the lamp vessel, the tangential ridge and the projection having mutually self-locating shapes upon a displacement of the mounting member towards the lamp vessel, while the tangential ridge blocks the projection in an opposed direction. An axial translation is sufficient then for fastening the collar with the lamp vessel to the mounting member. The one or several raised steps in the axial zone may form part of the tangential ridge.

It is favorable when at least one projection of the collar and a raised step of the axial zone have mutually cooperating profiles which allow of an axial displacement between the collar and the mounting member. The mutual engagement of the mutually cooperating profiles makes it clear to the user when the collar and the mounting member have the correct mutual tangential orientation for displacing these components axially relative to one another.

The mounting member may have, for example, a single axial zone. In that case, the lamp vessel can be detached by means of an axial translation after the projections of the collar have been brought to rest on the raised steps of this axial zone. An attractive embodiment is characterized in that the mounting member has mutually adjoining axial zones as described above, the raised step of a zone lying farther removed from the lamp vessel axially adjoining the recess of the axial zone lying closer to the lamp vessel. To remove the lamp vessel in a lamp according to this embodiment, a repetition of the movements (rotation and axial translation) is necessary. The risk of an inadvertent removal is strongly reduced thereby. It was found in practice that two axial zones are sufficient for this purpose. Given a large number of axial zones, for example more than three, the mounting member will occupy comparatively much space.

It is favorable when the collar with the lamp vessel can nevertheless be fastened on the mounting member in a single movement in this embodiment of the lamp. An attractive embodiment is for this purpose characterized in that each axial zone is provided with a tangential ridge as described above. The projection of the collar will then slide over the tangential ridges of the axial zones in a single axial translatory movement until it rests in the recess of the axial zone farthest removed from the lamp vessel.

An advantageous embodiment is characterized in that the coil is provided around a coil former which has a widened end which is clamped in between the flange and the mounting member. The coil can be readily assembled together with the other components in this embodiment. It suffices to pass the coil former over the heat conductor, whereby the widened end will come to bear on the flange, and to fasten the mounting member on the flange in the manner described above. The coil former will then be clamped in with its widened end between the flange and the mounting member.

It is favorable when the widened end of the coil former supports electrical contacts for connection of the coil to electrical conductors, while the mounting member has an annular portion which covers said electrical contacts. The user is protected against touching the electrical contacts also after uncoupling of the lamp vessel in that case.

An attractive modification of this embodiment is characterized in that a further electrical conductor is clamped in between the flange and the widened end of the coil former. The electrical connection between the electrical conductor, for example for interference suppression of the lamp, can thus be achieved without additional operations simultaneously with the fastening of the flange to the mounting member.

BRIEF DESCRIPTION OF THE DRAWINGS

These and other aspects of the lamp according to the invention will be explained in more detail with reference to the drawing in which.

DETAILED DESCRIPTION OF THE PREFERRED EMBODIMENT

Figure 1:
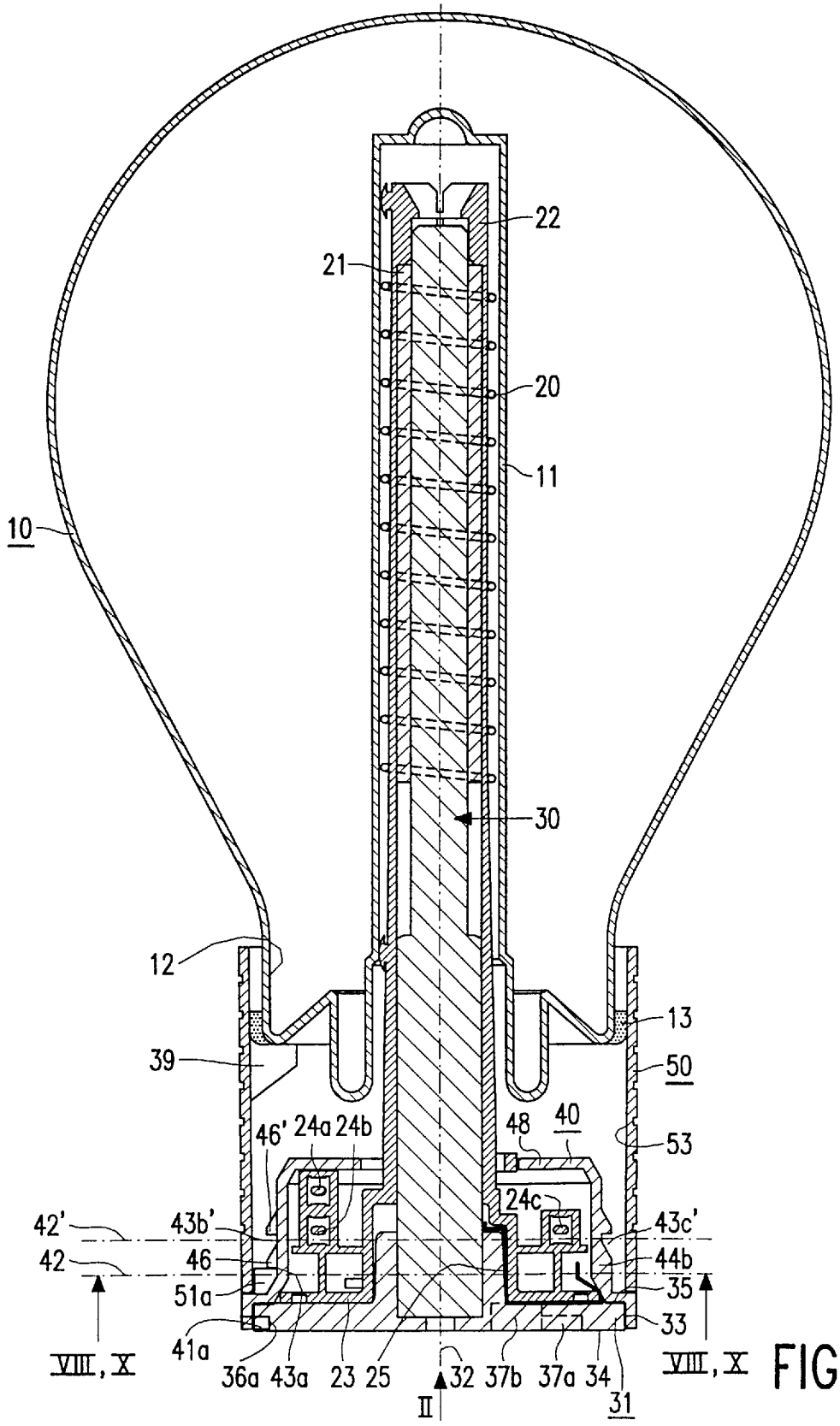
FIG. 1 is a longitudinal sectional view.

The electrodeless low-pressure discharge lamp shown in FIG. 1 is provided with a lamp vessel 10 which is closed in a gastight manner and which has an ionizable filling. The lamp vessel has a cavity 11 at an end portion 12, in which cavity an electric coil 20 is accommodated, here around a core 21 of soft magnetic material. Furthermore, a heat conductor 30 is accommodated in the cavity 11 and extends to outside this cavity, where it has a flange 31 with an axis 32, a circumference 33, a surface 34 which faces away from the lamp vessel, and a surface 35 which faces the lamp vessel, while a mounting member 40 fastened against the flange 31 is connected to the lamp vessel by means of a collar 50. In the embodiment shown, the end portion 12 of the lamp vessel 10 rests on supports 39 of the collar 50 and is secured in the collar with cement 13. Alternatively, for example, the end portion 12 of the lamp vessel may be held in the collar with clamping force.

Figure 2:
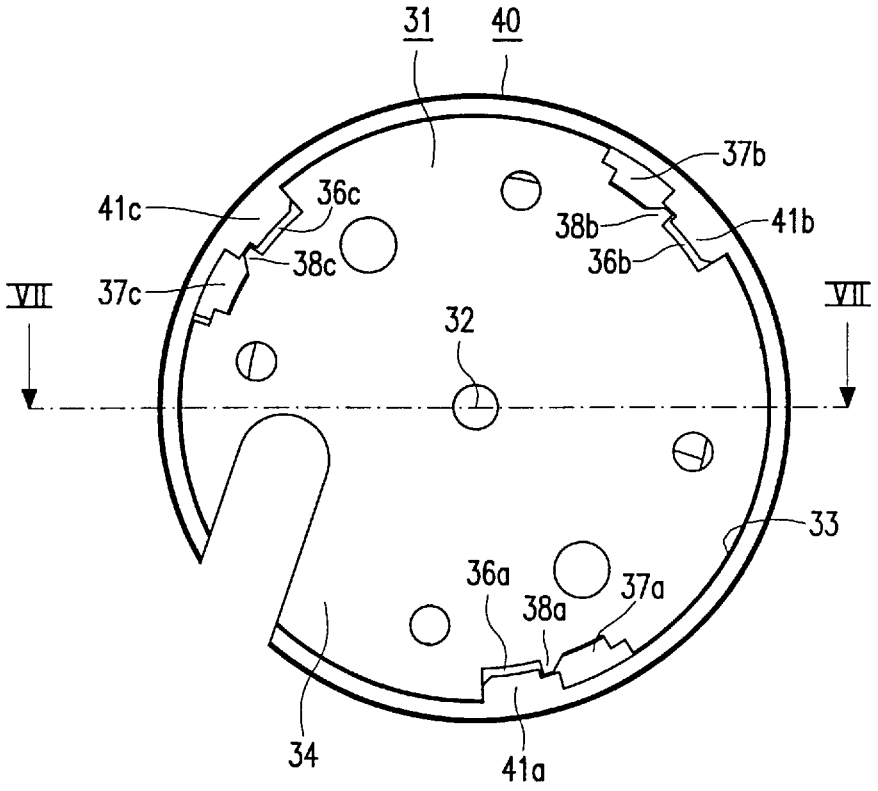
FIG. 2 is an elevation seen along II in FIG. 1, the lamp vessel being omitted.
Figure 3:
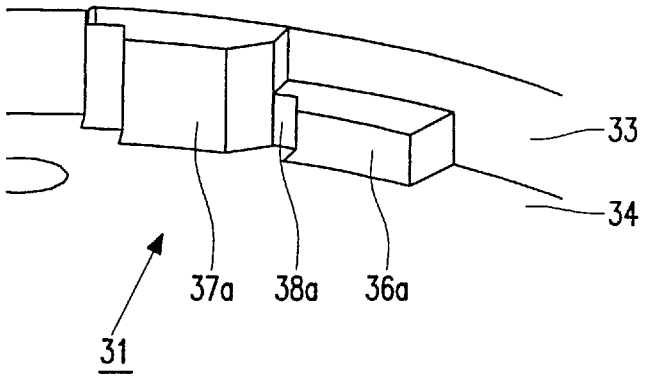
FIG. 3 is an elevation in perspective view of part of the flange.
Figure 4:
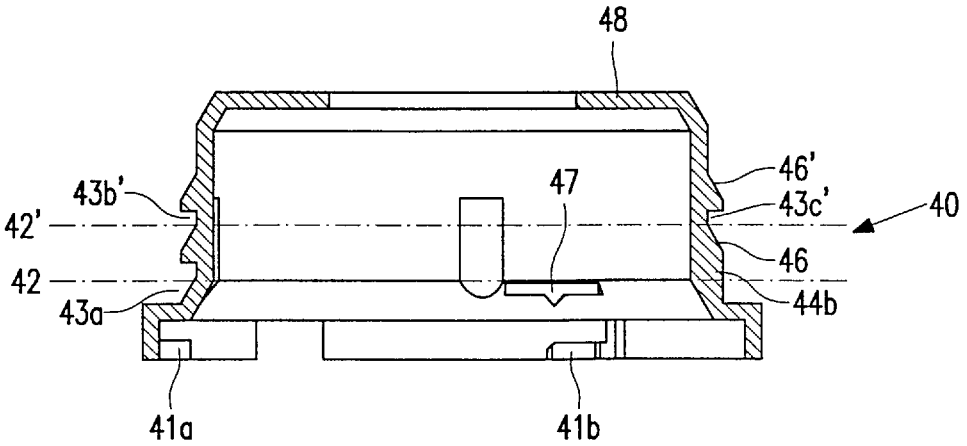
FIG. 4 shows the mounting member in a longitudinal section similar to FIG. 1.
Figure 5:
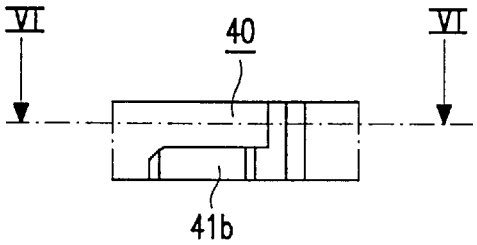
FIG. 5 shows a detail of the mounting member in the same longitudinal sectional view.
Figure 6:
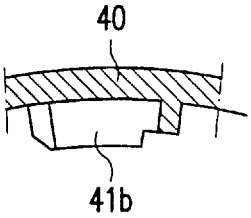
FIG. 6 shows the same detail taken on the line VI—VI in FIG. 5.

The mounting member 40 is provided with at least one hook 41*a* which points radially inwards (see also FIGS. 2 and 4) and which cooperates with a recess 36*a* in the surface 34 of the flange 31 facing away from the lamp vessel. The recess 36*a* (shown in detail in FIG. 3) issues into an axial groove 37*a* at the circumference 33 of the flange 31. The collar here has two further hooks 41*b*, 41*c* identical to the hook 41*a* and each cooperating with a recess 36*b*, 36*c* which issues into a respective axial groove 37*b*, 37*c*. One hook 41*b* of the mounting member is shown in detail in FIGS. 5 and 6.

In the embodiment shown, the mounting member 40 is made from an elastic material, and the flange 31 has a threshold 38*a* between the recess 36*a* and the corresponding axial groove 37*a*. The threshold 38*a* of the flange 31 and the hook 41*a* of the mounting member 40 have mutually self-locating shapes in a direction from the axial groove 37*a* towards the recess 36*a*. The threshold blocks the hook in an opposed direction so as to retain the hook in the recess. The flange 31 also has threshold 38*b*, 38*c* between the recesses 36*b*, 36*c* and the corresponding axial grooves 37*b*, 37*c*cooperating with hooks 41*b*, 41*c*, respectively, of the mounting member in the manner described above.

The flange 31 can be fastened in the mounting member 40 in that the mounting member 40 is placed on the flange 31 such that the hooks 41*a*, 41*b*, 41*c* of the mounting member 40 pass through the axial grooves 37*a*, 37*b*, 37*c* of the flange 31 and reach the surface 34 which faces away from the lamp vessel 10. Then the mounting member 40 can be rotated relative to the flange 31, so that the hooks 41*a*, 41*b*, 41*c* spring outwards at the areas of the thresholds 38*a*, 38*b*, 38*c* and subsequently snap themselves into the recesses 36*a*, 36*b*, 36*c*.

Figure 7:
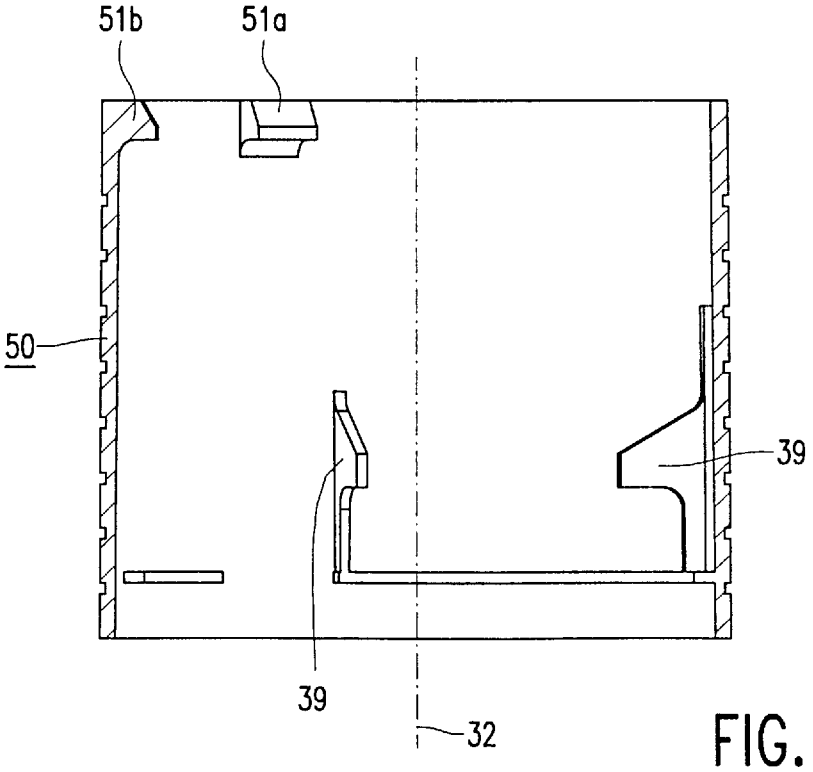
FIG. 7 is a longitudinal sectional view taken on the line VII—VII in FIG. 2 of the collar.
Figure 8:
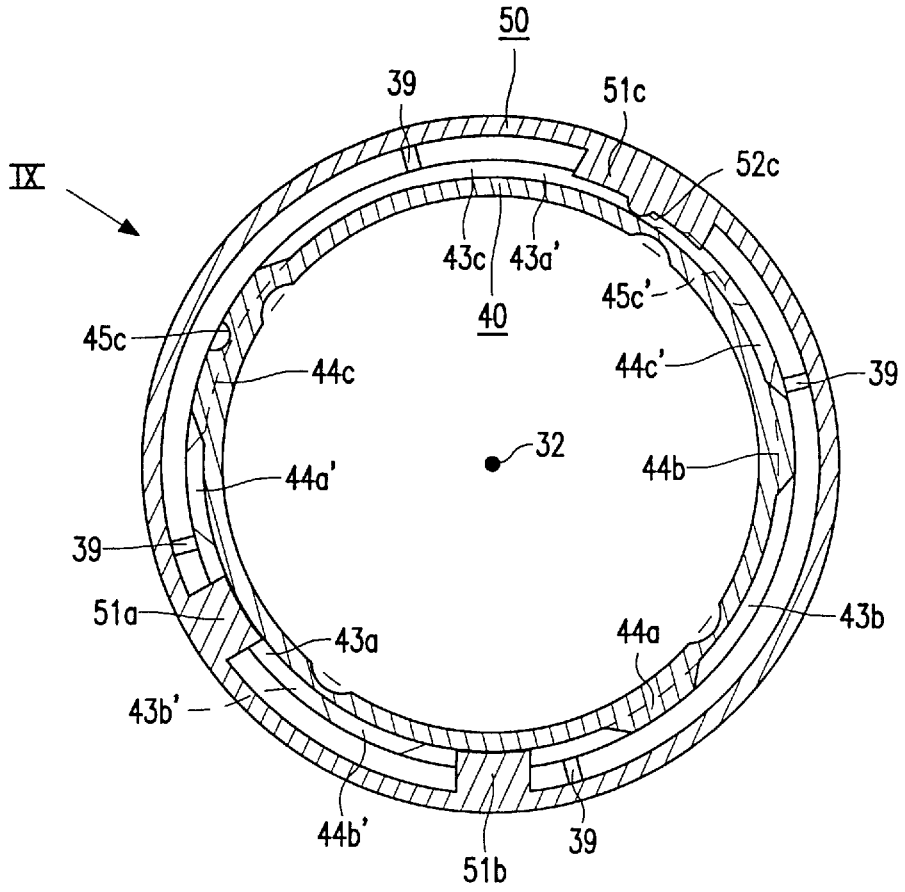
FIG. 8 is a cross-section taken on the line VIII—VIII in FIG. 1 of the collar and the mounting member in a first mutual tangential arrangement.
Figure 9:
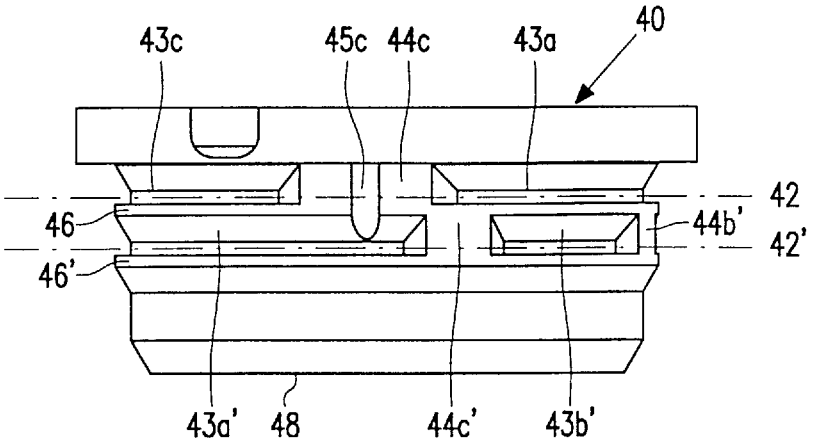
FIG. 9 is an elevation of the mounting member along IX in FIG. 8.

The collar 50 (see also FIG. 7) fastened to the end portion 12 of the lamp vessel 10 is provided with at least one projection 51*a* which points inwards and which rests in a recess 43*a* in a first axial zone 42 at an outer surface of the mounting member 40. FIG. 8 shows that the recess 43*a* is tangentially bounded by a raised step 44*a*. The raised step 44*a* of the mounting member 40 and the projection 51*a* of the collar 50 have mutually self-locating shapes in at least one tangential direction. In this case, the raised step 44*a* is beveled at both sides, so that the raised step 44*a* and the projection 51*a* have mutually self-locating shapes in both tangential directions. In the embodiment shown, the collar has two further projections 51*b*, 51*c*. The first axial zone 42 of the mounting member 40 has two further recesses 43*b*, 43*c* which adjoin raised steps 44*b*, 44*c*. Projection 51*b* is identical in shape to projection 51*a* and rests in recess 43*a* of the first axial zone 42 in the same manner. Projection 51*c* has a profile in the form of an axial ridge 52*c* and rests in recess 43*c* of the first axial zone 42. The axial ridge 52*c* cooperates with a profile in the form of an axial groove 45*c* in raised step 44*c* of the mounting member (see FIG. 9). The profiles allow of an axial displacement between the collar and the mounting member. The steps 44*b* and 44*a* have the same shape.

Figure 10:
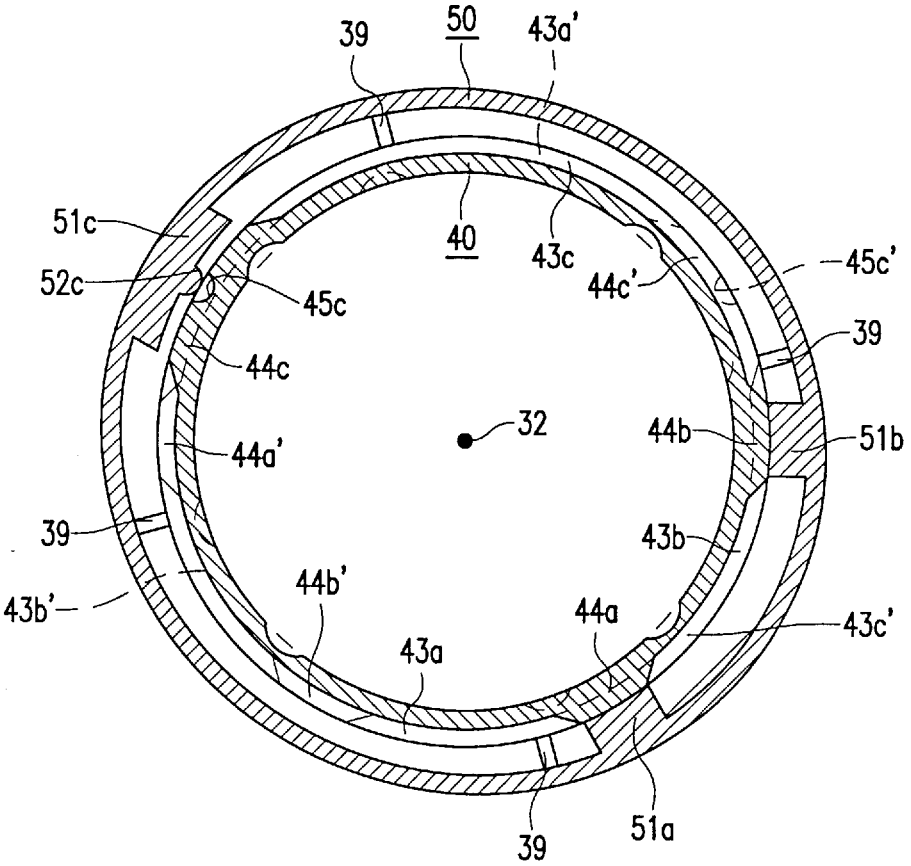
FIG. 10 is a cross-section taken on the line X—X in FIG. 1 of the collar and the mounting member in a second mutual tangential arrangement.

In the embodiment shown, the mounting member 40 has a second axial zone 42' which adjoins the first axial zone 42. The second axial zone 42', which lies closer to the lamp vessel 10, is identical in shape to the first axial zone 42, but is rotated through 120° relative thereto. Components of the second axial zone corresponding to those of the first have been given the same reference numerals with an accent mark added thereto. The second axial zone is shown in broken lines in FIGS. 8 and 10. The raised step 44*a* of the first axial zone 42 farther removed from the lamp vessel axially adjoins the recess 43*c'* of the axial zone 42' lying closer to the lamp vessel. The raised steps 44*b* and 44*c* axially adjoin recesses 43*c'* and 43*a'*.

An inadvertent removal of the collar 50 from the mounting member 40 is counteracted in that a series of different movement is required for this, i.e. a first rotation, a first axial translation, a second rotation, and a second axial translation. During the first rotation, the projections 51*a–c* of the collar 50 are rotated in the first axial zone 42 from the recesses 43*a–c* onto the raised steps 44*a–c* until the mutually cooperating profiles 52*c*, 45*c* of the projection 51*c* of the collar 50 and the raised step 44*c* of the mounting member 40 come into engagement with one another (see FIG. 10). Then the projections 51*a–c* of the collar 50 are passed from the raised steps 44*a–c* of the first axial zone 42 into recesses 43*a'*, 43*c'* of the second axial zone 42' in the first axial translation. In the second rotation, subsequently, the projections 51*a–c* of the collar 50 are rotated in the second axial zone 42' from the recesses 43*a'*, 43*c'* onto the raised steps 44*a–c'* until the mutually cooperating profiles 52*c*, 45*c'* of the projection 51*c* of the collar 50 and the raised step 44*c'* in the second axial zone 42' of the mounting member 40 come into engagement with one another. Finally, the collar 50 can be detached from the mounting member 40 by means of the second axial translation.

The recesses 43*a–c* in the first axial zone 42 are jointly bounded by a circumferential tangential ridge 46 at a side facing the lamp vessel, said tangential ridge and the projections 51*a–c* of the collar having mutually self-locating shapes upon a displacement of the mounting member 40 towards the lamp vessel 10, while the tangential ridge blocks the projections in an opposed direction. The raised steps 44*a–c* in the axial zone 42 form part of the tangential ridge 46. The second axial zone 42' is also provided with such a circumferential tangential ridge 46'.

The coil 20 is provided around a coil former 22 which has a widened end 23 which is clamped in between the flange 31 and the mounting member 40. The mounting member 40 has deformable bulges 47 at a surface facing away from the lamp vessel which are capable of compensating for any variations in the dimensions of the flange 31, the widened end 23 of the coil former 22, and the mounting member 20.

The widened end 23 of the coil former 22 carries electrical contacts 24*a–c* for connecting the coil 20 to electrical conductors (not shown). An annular portion 48 of the mounting member 40 covers the electrical contacts 24*a–c*.

An electrical conductor 25 is clamped in between the flange 31 and the widened end 23 of the coil former 22.

We claim:

1. An electrodeless low-pressure discharge lamp provided with a lamp vessel (10) which has an ionizable filling, which is closed in a gastight manner, which has an end portion (12) with a cavity (11) in which an electric coil (20) is accommodated, and in which in addition a heat conductor (30) is accommodated which extends to outside the cavity and has a flange (31) there with an axis (32), a circumference (33), a surface (34) which faces away from the lamp vessel and a surface (35) which faces the lamp vessel, a mounting member (40) which is fastened to the flange (31) being connected to the lamp vessel, characterized in that the mounting member (40) is provided with at least one hook (41*a*) which points radially inwards and which cooperates with a recess (36*a*) in the surface (34) of the flange which faces away from the lamp vessel, which recess issues into an axial groove (37*a*) at the circumference (33) of the flange (31), which groove extends up to the surface (35) which faces the lamp vessel.

2. An electrodeless low-pressure discharge lamp as claimed in claim 1, characterized in that the mounting member (40) is made of an elastic material, and the flange (31) has a threshold (38*a*) between the recess (36*a*) and the axial groove (37*a*), the threshold of the flange and the hook (41*a*) of the mounting member having mutually self-locating shapes in a direction away from the axial groove towards the recess, while the threshold blocks the hook in an opposed direction.

3. An electrodeless low-pressure discharge lamp as claimed in claim 1, characterized in that the end portion (12) of the lamp vessel (10) is fastened to a collar (50) which has at least one projection (51*a*) pointing inwards, and the mounting member (40) has an axial zone (42) with a recess (43*a*) and with a raised step (44*a*) tangentially bounding said recess at an outer surface, the projection of the collar resting in the recess of the first axial zone, while the raised step of the mounting member and the projection of the collar have mutually self-locating shapes in at least one tangential direction.

4. An electrodeless low-pressure discharge lamp as claimed in claim 3, characterized in that at least one projection (51*c*) of the collar (50) and at least one raised step (44*c*) in the axial zone (42) of the mounting member (40) have mutually cooperating profiles (52*c*, 45*c*, respectively) which allow of an axial displacement between the collar and the mounting member.

5. An electrodeless low-pressure discharge lamp as claimed in claim 3, characterized in that the recess (43*a*) in the axial zone (42) is bounded by a tangential ridge (46) at a side which faces the lamp vessel (10), the tangential ridge (46) and the projection (51*a*) having mutually self-locating shapes upon a displacement of the mounting member towards the lamp vessel, while the tangential ridge blocks the projection in an opposed direction.

6. An electrodeless low-pressure discharge lamp as claimed in claim 3, characterized in that the mounting member has mutually adjoining axial zones (42, 42') as described in that Claim, while the raised step (44*a*) of a zone (42) lying farther removed from the lamp vessel axially adjoins the recess (43*c'*) of the axial zone (42') lying closer to the lamp vessel.

7. An electrodeless low-pressure discharge lamp as claimed in claim 1, characterized in that the coil (20) is provided around a coil former (22) which has a widened end (23) which is clamped in between the flange (31) and the mounting member (40).

8. An electrodeless low-pressure discharge lamp as claimed in claim 7, characterized in that the widened end (23) of the coil former (22) supports electrical contacts (24*a*, 24*b*, 24*c*) for connection of the coil (20) to electrical conductors, and in that the mounting member (40) has an annular portion (48) which covers said electrical contacts.

9. An electrodeless low-pressure discharge lamp as claimed in claim 7, characterized in that an electrical conductor (25) is clamped in between the flange (31) and the widened end (23) of the coil former (22).

* * * * *